United States Patent [19]

Loeffler

[11] 3,930,926

[45] Jan. 6, 1976

[54] APPARATUS FOR FORMING TUBULAR FIBROUS INSULATORY ARTICLES

[75] Inventor: Romain Eugene Loeffler, Defiance, Ohio

[73] Assignee: Johns-Manville Corporation, Denver, Colo.

[22] Filed: July 2, 1973

[21] Appl. No.: 376,064

Related U.S. Application Data

[63] Continuation of Ser. No. 180,322, Sept. 14, 1971, abandoned.

[52] U.S. Cl. ..... 156/446; 156/62.6; 156/463

[51] Int. Cl.[2] ..... B30B 3/04; B29J 1/00

[58] Field of Search ..... 156/62.2, 62.6, 184, 192, 156/204, 227, 446, 463, 465, 580

[56] References Cited

UNITED STATES PATENTS

| | | | |
|---|---|---|---|
| 2,165,280 | 7/1939 | Lannan | 156/62.6 |
| 2,331,146 | 10/1943 | Slayter | 156/184 |
| 2,503,041 | 4/1950 | Greene | 156/62.6 |
| 2,509,715 | 5/1950 | Allen et al. | 156/446 |
| 3,063,887 | 11/1962 | Labino | 156/446 |
| 3,140,968 | 7/1964 | Barrios et al. | 156/192 |
| 3,347,725 | 10/1967 | Stephens et al. | 156/184 |

*Primary Examiner*—Douglas J. Drummond
*Assistant Examiner*—Basil J. Lewris
*Attorney, Agent, or Firm*—Robert M. Krone; John H. Miller

[57] ABSTRACT

Apparatus for forming the edges of mineral fiber blankets during their advance along a processing path. Guide means having surfaces shaped to continuously direct feathered or ragged longitudinal edges of an uncured mat of mineral fibers as it is introduced to forming apparatus causes a gathering of the fibers to control the uniformity of the density of the edge portion of the mass. The guide can comprise surfaces extending radially outward at the effective ends of a pressure roll cooperating with a rotatable mandrel in the formation of tubes of fiber mat. The first surface encountered by an advancing blanket raises the feathered edge. The raised edge is turned inward toward the major body portion of the blanket by a second surface. A third surface parallels the path of advance to establish the desired margin and maintain that margin as the blanket is compacted in its major face. Other surfaces can be provided to form or shape the marginal edges of the mass of mineral fibers to obtain a desired configuration, for example, square or chamfered edges.

7 Claims, 17 Drawing Figures

INVENTOR.
ROMAIN EUGENE LOEFFLER
BY Robert M. Krone
ATTORNEY

STATION A

STATION B

STATION C

STATION D

STATION E

STATION F

STATION F

STATION F

INVENTOR.
ROMAIN EUGENE LOEFFLER
BY Robert M. Krone
ATTORNEY

APPARATUS FOR FORMING TUBULAR FIBROUS INSULATORY ARTICLES

This is a continuation of application Ser. No. 180,322, filed Sept. 14, 1971, and now abandoned.

BACKGROUND OF THE INVENTION

In the formation of mineral fiber products produced from an uncured mass of mineral fibers 1971, for example, by flame attenuating glass filaments drawn from molten glass and gathering the attenuated fibers on a foraminous conveyor subsequent to spraying them with a resin binder, considerable loss of product has been encountered due to uneven or low density marginal edges. Typically, the mass of glass fibers tends to build up uniformly over the major portion of the width of the mass and tapers off toward the marginal edges. As a result, after the product, for example a mat or tube, formed from the mass is cured, the marginal edges must be trimmed to obtain square edges of uniform density.

Where the mass of uncured glass fibers is wrapped about a mandrel to form a tubular shape with the marginal edges forming the ends of the tubular object, low density ends were found to be of such a soft nature as to cause the ends to yield and to interfere with the manipulating apparatus for the tubular objects in the process of manufacture. Typical malfunctions attributable to the soft ends of the tubular objects incude the misalignment of the object which causes jamming of the flow of tubular objects. Further, tubular objects with soft ends are susceptible to damage for shipping and handling.

Heretofore, the problem of soft tapered ends or edges of lower density material have been overcome by trimming the ends or edges at an early processing stage. However, in either trimming the edges of a cured mat to produce an insulating board after curing or trimming the uncured intermediate product to obtain the desired shape for a tubular object, a substantial loss of material results. In both cases the glass fibers have been coated with resin and therefore the glass trimmed away can not be recycled.

The above problems are overcome by the present apparatus which gathers the ragged edges of the uncured mass of glass fiber and forms desired shapes for the edges and ends, as the case may be, and establishes the desired density of the material in those regions. Density control can be such as to maintain uniformity across the article or the apparatus may be used to increase the density of the edges or ends over the center portion of the product. An increase in density may be desirable where the ends or edges receive excessive or abusive handling and to militate against shipping damage.

The uncured mat, tubular object, or other product formed from the mass of mineral fibers is an intermediate product which is useful for producing numerous final products. For example, the tubular objects can be further processed into filters and the mat into insulating board.

SUMMARY OF THE INVENTION

The present invention relates to apparatus for forming products from a mass of mineral fibers and more particularly to guide means for controlling the density of the extremities of intermediate products formed while the mass of mineral fibers is in an uncured state.

In line application of the guide means along the path of advance of a blanket of fibers, as between the means developing the fiber blanket and the means for forming the blanket into a product, provides the opportunity for the guide means to shape the mass prior to curing it.

The guide means or edge forming station comprises means to gather and constrain the feathered edges produced along the longitudinal margin of the blanket in its initial formation. As the blanket is advanced along a path to the means establishing its form for curing the feathered edges are turned out of the major face of the blanket, as by raising them on surfaces which are at an obtuse inclination to the face and extend along the path of advance. The turned edges are then directed toward the major face, as by rolling them inward to fold them into the thicker blanket portions, by guide means which can be a surface inclined at an obtuse angle to the path of advance to progressively approach the blanket longitudinal centerline in the direction of advance and advantageously also inclined with respect to the face of the blanket a greater degree than the turning surface. A desired edge configuration is then formed by a surface paralleling the path of advance of the blanket and cooperating with elements confining the opposed major face portions adjacent the edge portion. Advantageously, the turning, directing and forming surfaces are contiguous and developed in a unitary structure as the guide for each longitudinal edge.

Other surfaces can be provided to further impart a folding action which turns the extremities of the mass inwardly upon itself prior to contacting the final forming surface of the guide.

The present apparatus is one which by forming the shape of a mass of mineral fibers into an intermediate product having the general shape of the final product, eliminates the step of trimming either the intermediate or final products and prevents waste of material normally lost in the trimming operation. Further, the control of the density at the extremities of the intermediate product has resulted in elimination of soft ends which previously caused product misalignment and jamming of line equipment. The uniform density of the product extremities also militates against damage to these portions from handling and shipping.

DESCRIPTION OF THE PREFERRED EMBODIMENT

Figure 1:
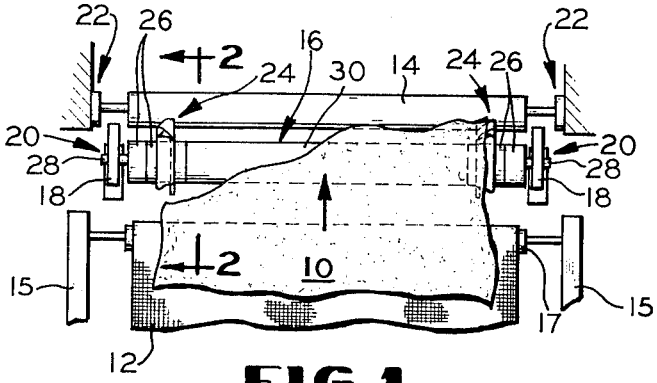
FIG. 1 is a top view of equipment for forming tubular objects illustrated schematically in part and incorporating apparatus in accordance with the present application.
Figure 2:
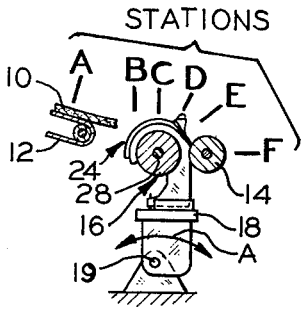
FIG. 2 is a sectional view of the equipment and apparatus of FIG. 1 taken along line 2—2 thereof.
Figure 5A:
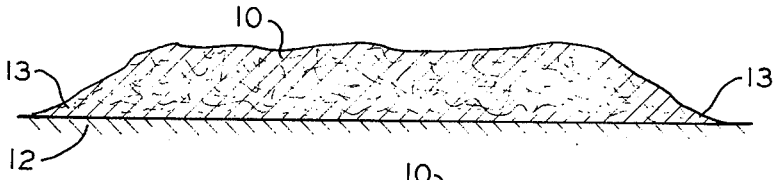
FIGS. 5A through 5H represent a series of cross-sectional views of the blanket taken normal to the blanket major face for stations along the edge guide and forming apparatus as indicated in FIG. 2 to illustrated the progressive shaping of the blanket edge as it is advanced along its path of travel.

FIGS. 1 and 2 illustrate, the equipment for forming tubes for a mass of fibers 10 formed on a continuous foraminous conveyor 12 by, for example, flame attenuation of glass filaments to form the fibers which are adhered to each other by a resin binder in an uncured state. The uncured mass of glass fibers 10 tends to build up uniformly over a major portion of the width of thhe conveyor 12 and taper off at the marginal edges 13 of the mass 10 as shown in FIG. 5A. Since the resin binder is in the uncured state, the mass of glass fibers 10 is pliable, though having some resiliency, and is readily shaped because relative movement between the glass fibers in the mass 10 can occur and the tacky coating gives them the tendency to stick to each other upon contact. A tube is formed from the loose blanket 10 of fibers by wrapping a given length of the blanket about the mandrel 14 while the mass 10 is in the uncured state. The proper outside diameter of the tube and wall thickness is developed by providing a pressure roll 16 which forcefully bears against the material being warpped on the mandrel as the tube is formed.

In practice, blanket 10 is advanced along a path from conveyor 12 over press roll 16 to mandrel 14 which is heated to sear and thereby secure the blanket. Mandrel 14 is turret mounted so that it can be positioned at a series of stations (not shown) for the curing and further processing of the fiber tube formed thereon. Mandrel 14 is shown in its winding station wherein it is driven in rotation to wind the blanket thereon. Press roll 16 is mounted to swing in an arc generally coincident with a radius from mandrel 14 and is biased toward the mandrel with a controlled pressure so that as the wall of the fiber tube builds with successive layers of wrapped blanket, the roll 16 retreats from mandrel 14. Roll 16 is driven through an over riding clutch (not shown) at a peripheral speed of the first layer of blanket on the mandrel. As the layers build, the increased peripheral speed of the mandrel therefore tends to take over drive of the press roll 16.

The frame 15 of conveyor 12 is movable in an arc generally normal to the plane of upper flight 12 so that as a length of fiber blanket is to be introbetween mandrel 14 and roll 16 flight 12 is above the upper limit of roll 16. As the blanket supporting portion of 12 passes around end roll 17 an air blast from beneath the conveyor lifts the blanket and causes it to be advanced across the gap to the upper face of pressure roll 16. Pressure roll 16 rotates to carry the blanket around its upper surface since it rotates clockwise as viewed in FIGS. 2 and 3. Counterclockwise rotation of mandrel 14 picksup the surface of the blanket which was previously uppermost and is adhered to that surface by a heat cure of the binder contacting that surface. Thereafter the blanket length is drawn from the conveyor by the driven rotation of the mandrel 14. When a length of blanket has been wrapped on a mandrel 14, the turret mounting indexes one position to advance the wrapped mandrel to a further processing station and introduce an empty preheated mandrel to the wrapping station.

The length of the tubes formed on mandrels 14 are defined by plate guides 24 properly located along the pressure roll 16 at each end to provide a distance between them equal to the length desired for the tubes. Advance of the blanket of glass fibers 10 from the conveyor 12 to the tube shaping means, ie., the pressure roll 16 and mandrel 14, causes the mass 10 to pass over the pressure roll 16 between the plate guides 24. As the marginal edges of the mass of glass fibers 10 contacts the leading or upstream portions of the plate guides they are lifted and turned inward upon the thicker body portions of the blanket to build up the marginal edges and increase their density while reducing the transverse dimension of the product formed as illustrated in FIG. 1. The pair of plate guides 24 work in conjunction with each other to cause a converging action toward the mass of glass fibers 10 along a path in the direction of movement of the mass 10 over the portion of the length of its path where contact is made with the plate guide 24. While both marginal edges of the mass of glass fibers 10 are contacted in the embodiment illustrated, if desired, a single plate guide 24 could be used to contact a single marginal edge. The plate guides 24 are located between segments 26 on each end of the pressure roll 16. Attachment of the segments is accomplished by sliding an aperture therein over an axle 28 extending from a long body portion 30 of the pressure roll. The segments 26 are used to vary the effective length of the pressure roll 16 to match the length of the tube being produced. Movement of the plate guides transverse of the axis 28 is accommodated by securing the segments to the axle 28 with a spacer between them, or between the body portion 30 and a segment 26, slightly larger than the thickness of a portion of a plate guide 24.

Figure 3:
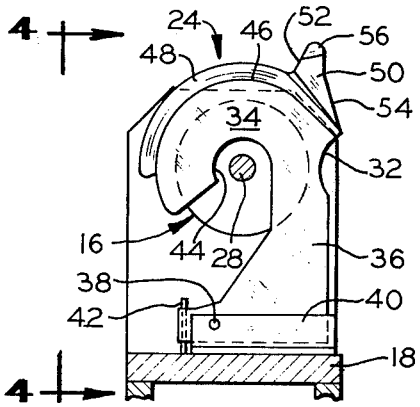
FIG. 3 is an enlarged fragmentary view of the apparatus illustrated in FIG. 2.

The above movement of the plate guide 24 is important because, as described above, the pressure roll 16 bears against the material being wrapped on the mandrel 14 which material is built up by a series of turns of the mandrel 14. When the pressure roll 16 is moved away from the mandrel upon build up of the wall thickness of the tube being formed, the plate guide 24 moves relative to the pressure roll 16 to thereby remain in contact with the mandrel 14. Movement of the pressure roll 16 is accomplished by pivotally mounting the pressure roll base 18 around pivot 19 as indicated schematically in FIG. 2 in the directions of the arrows at A. A contour edge 32 of the plate guide 24, best illustrated in FIG. 3, provides contact between the plate guide 24 and the mandrel 14 over a portion of the circumference of the mandrel 14. The contour edge 32 is on a flange 34 of the guide plate. The line contact between the contour edge and the face of the mandrel 14 establishes a portion of the flange 34 located between the pressure roll 16 and the mandrel 14 as an end wall for conforming the material of which the tube is formed.

Figure 4:
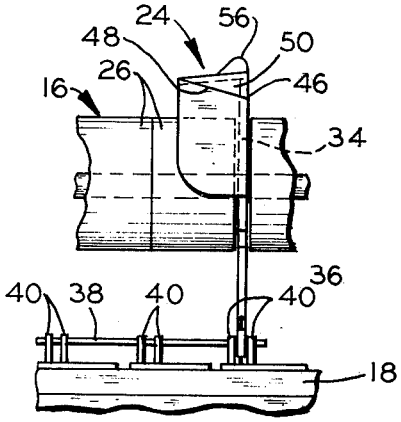
FIG. 4 is an elevation of the apparatus illustrated in FIG. 3 and a portion of the elements cooperating therewith taken along line 4—4 thereof.

Mounting the plate guide 24 in a pivotal manner provides it with the necessary freedom to move. The mounting is accomplished by extending the flange 34 below the contour edge 32 toward the pressure roll base 18 to form an arm 36 which is affixed to pivot rod 38 passing through a suitable aperture in the arm 36. FIG. 4 illustrates a plurality of upstanding ears 40 for pivotally supporting the pivot rod 38 on the pressure roll base and for providing a selection of mounting positions along the rod axis corresponding to the desired length of the tubes to be formed. Eccentrically mounting the plate guide 24 on the rod 38 results in a tendency for the plate guide 24 to swing toward the mandrel 14 under the influence of gravity to maintain contact with the mandrel 14. For more positive positioning of the plate guide 24 a spring, not illustrated, could be added between the plate guide 24 and the pressure roll base 18 to bias the plate guide toward the mandrel 14. Further, the arm 36 of the plate guide 24 may be provided with stops such as pin 42 adapted to abut pressure roll base 18 for limiting the arcuate motion of the plate guide 24. Pin 42 can be adjustably secured to arm 36 to establish a desired limit. Alternate means for limiting the movement of the plate guide 24 could be provided including screws and protuberances which could also be located on the opposite side of the axis from the position illustrated for the pin 42.

Guide 24 is composed of three primary functioning elements. The functions of those elements are illustrated in FIG. 5 as they operate on a given cross section of the blanket or conveyor 12 as it is passed to pressure roll 16 and then between roll 16 and mandrel 14. The feathered edges 13 of the blanket 10 of fibers are engaged by turning a surface 48 which generally conforms to the path of the blanket and is inclined to the blanket major faces at an obtuse angle. In the case of a path over a cylindrical surface, the turning surface 48 can be a sector of a frustum of a cone having a length sufficient to extend around the pressure roll 16 from a location in advance of any contacted by blanket 10 to a point where the edges 13 have been turned inward on the major body portion of the body.

Figure 5B:
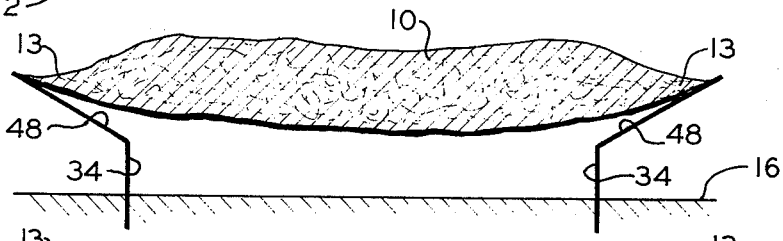
Figure 5C:
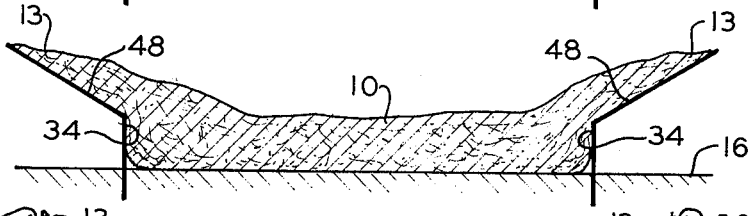

As viewed in FIG. 5A the blanket at station A of FIG. 2 has feathered edges 13 which are picked up by turning surfaces 48 before the major surface of the blanket engages roll 16 as at station B of FIG. 2 and FIG. 5B. When advanced to station C of FIG. 2, the blanket major surface is supported by roll 16 as shown in FIG. 5C. In this state the feathered edges are upstanding and somewhat drawn in toward the major body portion of blanket 10.

Figure 5D:
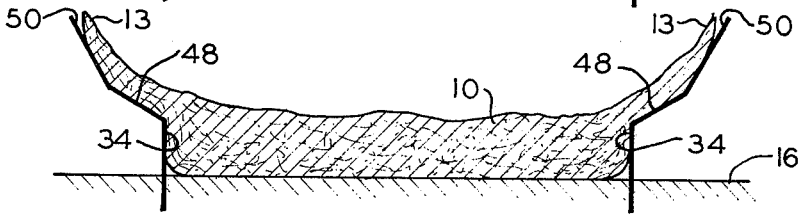
Figure 5E:
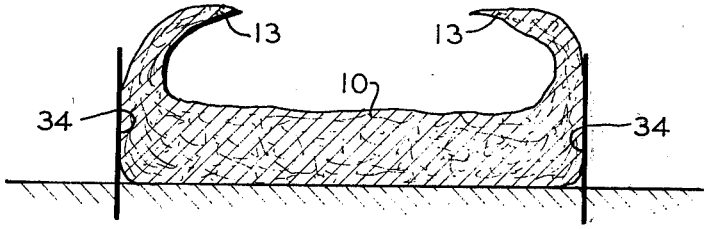
Figure 5F:
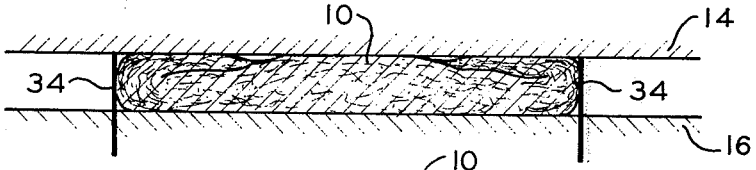
Figure 5G:
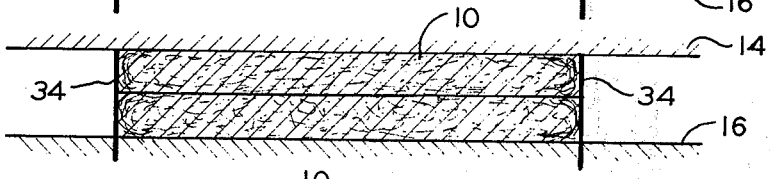
Figure 5H:
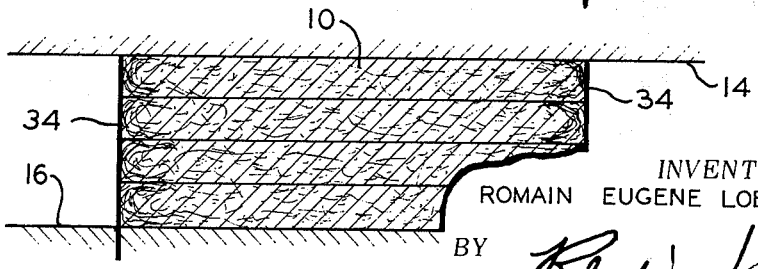

The further advance of blanket 10 brings its elevated edges into contact with a directing surface in the form of ear 50 which is contiguous with turning surface 48 and is inclined with respect to the path of advance of the blanket at an obtuse angle so that as the blanket advances the edges are turned inward as shown in FIG. 5D depicting station D of FIG. 2. Downstream of station D the directing surface 50 is closer to the centerline of the blanket path so that the rolling of the edge is greater. Surface 50 converges to the flange 34. Flange 34 in the region between the pressure roll and the mandrel comprises the ultimate blanket edge forming face of guide 24. Station E of FIG. 2 and FIG. 5E illustrate the initial location where guide surfaces normal to the roller are exclusively presented to the edges 13.

The gathered and turned in edges are compressed to a uniformly dense mass between mandrel 14 and pressure roll 16 as shown at Station F of FIG. 2 and FIGS. 5F, 5G and 5H representing the first and second and fourth wraps of blanket 10 at that station.

Since the edge portions can be gathered by an elevating means which either lifts or depresses relative to the blanket, and the directing means can complement that displacement in either direction, it should be appreciated that the edge forming techniques are adaptable to various blanket path orientations including vertical runs provided the blanket is controlled in its travel. Further, the path of the blanket need not be carried around right-circular cylinders of the type represented by pressure roll 16 and mandrel 14.

In the curved blanket path the flange 34 is shaped in the general form of a sector of an annulus with an opening 44 in the center to fit over the pressure roll axle 28. The opening 44 is of sufficient size to allow free movement of the plate guide 24 about the axis 38. The outer edge portion 46 of the flange 34 is inclined at an obtuse angle to the major face of the blanket 10 over a curved surface following the curve of roll 16 in the general form of a sector of a frusto conical surface 48 having its major base toward the proximal end of the pressure roll 16. The frusto conical surface extends from the region into which conveyor flight 12 carries fiber blanket 10 as the flight is carried about a roller 45 to a region approaching that between the pressure roller and the mandrel 14 upon which the blanket is wound. The inclination of conical surface 48 toward the flange 34 lifts and initiates an inward folding of the longitudinal edge of the blanket which is augmented by ears 50 having a greater inclination to the direction of advance of the blanket.

Ears 50 extend across the width of the conical surface 48 and project outwardly therefrom with a leading edge 52 facing upstream of the movement of the mass of glass fibers 10 and a trailing edge 54 downstream. The leading edge 52 is positioned on the outer edge of the conical surface 48 a distance from the trailing edge 54 greater than the axial height of the conical surface 48 so that ear 50 forms a surface which may be plane or curved and is presented to the advancing mass of glass fibers 10 at an inclination to the direction of advance of the mass and a greater inclination to the major face of blanket 10 than the surface 48. As the marginal edge of the mass of glass fibers 10, which has been lifted upward in a folding motion imparted by the arcuate surface 48, approaches the converging surface 50, a further folding is imparted upon contact with the converging surface 50 to direct the marginal edge in upon the mass 10. The above folding action of the marginal edges by the surfaces 48 and 50 of the plate guides 24 gathers the feathered or ragged material of the marginal edges and directs it to the shaping or forming surface of the flange 34 adjacent the contour edge 32 forming the end wall for the tube.

A further extension 56 of the ear 50 has a surface extending outwardly from the plate guide toward the proximal end of the pressure roll 16 from the converging surface of ear 50. Extension 56 serves to gather in any fringes of the marginal edge of the mass of glass fibers 10 extending beyond the converging surface of ear 50.

The plate guide 24 controls the density of the edges by continually folding the longitudinal marginal edges of the given length of a mass of glass fibers 10 using the first generally frusto conical and augmenting converging surfaces 48 and 50 together the feathered marginal edge material and direct it to the second edge forming or shaping surface such as the annular portion 34. The annular portion 34 is illustrated as being normal to the major surface of the fiber blanket 10 and the axis of rotation of mandrel 24 to form a square edge on the mass 10 and therefore on the end of the tube. It is to be understood that other surface orientation or shapes of the end wall portion of the flange 34 could be incorporated to impart other shapes to the end of the tube, for example, a chamfer. The amount of gathering on the marginal edges is a function of the width of the surfaces which gather and direct the material to the forming or shaping surface and the density of the material in the blanket portion operated upon by the guide. The above approach is a direct approach to density control which is superior to gauging the depth of the wall formed on the object because depth alone is not determinative of the density of an object.

Figure 6:
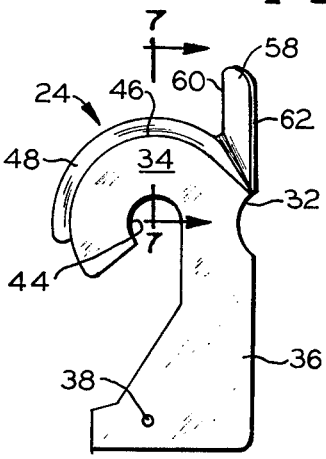
FIG. 6 is an alternate embodiment of the apparatus illustrated in FIG. 3.
Figure 7:
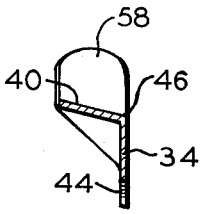
FIG. 7 is a sectional view of a portion of the apparatus illustrated in FIG. 6 taken along line 7—7 thereof.

FIGS. 6 and 7 illustrate a modification of the apparatus of FIGS. 3 and 4 having only one converging surface 58 in conjunction with the frusto conical surface 48. Surface 58 converges with respect to the direction of advance of the blanket, however it is essentially perpendicular to the major face of the blanket and has generally vertically extending leading and trailing edges 60 and 62. The modified form is simpler to manufacture while the original has leading and trailing edges 52 and 54 more accommodating to the natural fall of displacement of the mass of glass fibers and has the additional directing surface in the ear portion 56.

Figure 8:
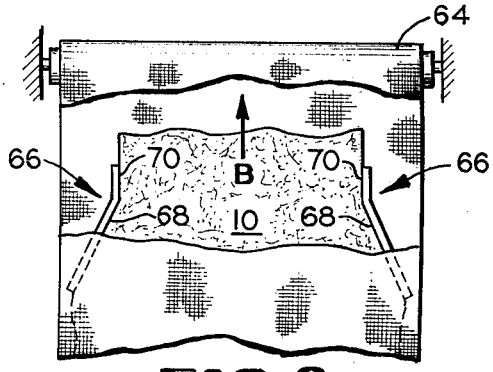
FIG. 8 is a top view of equipment for forming a mat illustrated schematically with parts broken away to reveal greater detail and incorporating another embodiment of the present invention.
Figure 9:
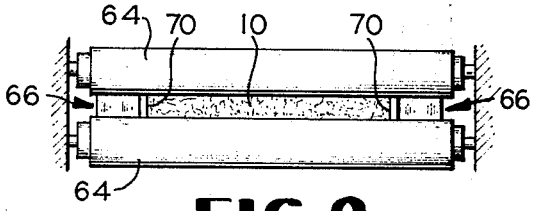
FIG. 9 is an elevational view of the equipment and apparatus illustrated in FIG. 8.
Figure 10:
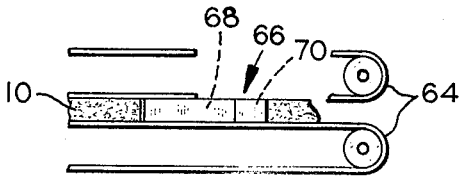
FIG. 10 is an end view of the equipment and apparatus illustated in FIG. 8.

FIGS. 8, 9, and 10 illustrate another blanket margin guide for use in forming mats such as for thermal insulating batts or fiber board between two conveyor flights 64 from a mass of mineral fibers 10 in the uncured state where a pair of bar guides 66 are used to enclose the sides of the conveyors over a portion of their length. The mass of glass fibers 10 moves continuously past the bar guides 66 in the direction of the arrow at B under impetus of the moving conveyors 64 which confine the upper and lower surfaces of the mass 10. The guide bars 66 have surfaces 68 which converge in the direction of movement of the mass of glass fibers 10 togather and direct the longitudinal marginal edges of the mass 10 to the shaping surfaces 70 which impart a square edge to the mass 10 to form the mat upon leaving the bar guide 66. The mat can subsequently be cut to the desired length.

The converging and shaping surfaces 68 and 70 extend over the distance between the conveyors 64 and are in contact with the conveyors over the length of the bar guide 66.

The present apparatus provides a means of shaping or forming the ends and/or edges of products produced from a mass of glass fibers having uniform density ends with the remainder of the product and of the desired configuration. The apparatus may also be used to produce ends or edges of a greater density than the remainder of the product.

By using the apparatus on an uncured mass of glass fibers to produce an intermediate product which can be subsequently cured to set its shape, the operation of trimming the produce subsequent to its formation has been eliminated together with the previous loss of material from trimming. The uniform density of the ends and/or edges of the intermediate product makes the product less susceptible to handling and shipping damage in both the intermediate and final stages of the product. Further the problems of jamming through misalignment of the products caused by soft ends climbing intermediate line operation transfer chutes has been eliminated resulting in more efficient line operation.

In view of the variations in structure embodying the invention and the wide range of their utilization, it should be understood that the above disclosure is merely illustrative and should not be read in a limiting sense. The invention may be practiced otherwise than as specifically illustrated and described without departing from its spirit or scope.

I claim:

1. In an appartus for forming a tubular shaped article from a continuous fibrous blanket having a binder therein, said blanket having a thick body portion and at least one feathered longitudinal edge portion generally paralleling its direction of advance, including a mandrel for winding said blanket around to form said tubular article, a pressure roll for forcefully bearing against said blanket while it is being wrapped around said mandrel, and a conveyor for conveying said blanket to said mandrel, the improvement comprising:

means for gathering said feathered edge portion, for displacing said edge portion towards said thick body portion without severing the blanket, and for forming regular ends having a more uniform density on said tubular article, said gathering, displacing, and end-forming means comprising at least one forming member pivotally mounted in the path of said blanket at a point in the path before said blanket reachs said mandrel, said forming member having a first surface extending parallel to the direction of advance of the blanket and inclined to a major face of said blanket at a first obtuse angle, a second surface in the form of an ear contiguous with said first surface and inclined with respect to the advance of the blanket at a second obtuse angle, said second surface being inclined with respect to the face of the blanket a greater degree than said first surface, and a third surface lying in a plane perpendicular to the axis of said mandrel and defining a tube end forming face, said first surface extending around said pressure roll from a location in advance of where said blanket contacts said roll to a point where said feathered edge has been gathered and displaced toward said thick body portion, said second surface being contiguous with and located downstream from said first surface, and said third surface being adjacent to said pressure roll at a point downstream from said second surface.

2. The apparatus as defined in claim 1 wherein the first surface of said forming member is in the shape of a sector of a frustum of a cone.

3. The apparatus as defined in claim 2 wherein the ear extends across the width of said conical sector and projects outwardly therefrom with a leading edge facing upstream of the moving blanket and a trailing edge facing downstream.

4. An apparatus as defined in claim 2 wherein the ear has a surface extending outwardly toward the end of said pressure roll to gather in any fringe of the feathered edge of said blanket.

5. An apparatus as defined in claim 2 wherein said leading and trailing edges are of a shape accommodating the natural fall of displacement of said feathered edge and said ear has an additional directing surface inclined towards said thick body portion.

6. An apparatus as defined in claim 2 wherein the ear converges in conjunction with the first surface with respect to the direction of advance of the blanket, is essentially perpendicular to the major face of the blanket, and has generally vertically extending leading and trailing edges.

7. An apparatus as defined in claim 1 wherein the pivotally mounted forming member is eccentrically mounted in such a manner that said forming member has the tendency to swing towards said mandrel.

* * * * *

UNITED STATES PATENT AND TRADEMARK OFFICE

CERTIFICATE OF CORRECTION

PATENT NO. : 3,930,926
DATED : January 6, 1976
INVENTOR(S) : Romain Eugene Loeffler It is certified that error appears in the above-identified patent and that said Letters Patent are hereby corrected as shown below:

Column 1, line 10, after "fiber" delete --1971--

Column 1, line 32, "for" should read --from--

Column 3, line 12, "the" should read --schematically,--

Column 3, line 13, "for" should read --from--

Column 3, line 18, "thhe" should read --the--

Column 4, line 33, "axis" should read --axle--

Column 5, line 21, "or" should read --on--

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*